US007162183B2

(12) United States Patent
Jeon

(10) Patent No.: US 7,162,183 B2
(45) Date of Patent: Jan. 9, 2007

(54) DEVELOPING UNIT WITH DEVELOPING GAP CONTROL

(75) Inventor: In-cheol Jeon, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 207 days.

(21) Appl. No.: 10/778,155

(22) Filed: Feb. 17, 2004

(65) Prior Publication Data

US 2005/0013627 A1 Jan. 20, 2005

(30) Foreign Application Priority Data

Jul. 14, 2003 (KR) ..... 10-2003-0047913

(51) Int. Cl.
*G03G 21/18* (2006.01)

(52) U.S. Cl. ..... 399/113; 399/119

(58) Field of Classification Search ..... None
See application file for complete search history.

(56) References Cited

U.S. PATENT DOCUMENTS 5,839,021 A * 11/1998 Hayashi et al. ..... 399/55
5,950,048 A * 9/1999 Okumura et al. ..... 399/113
6,104,895 A * 8/2000 Yokomori et al. ..... 399/113
6,704,529 B1 * 3/2004 Noh ..... 399/167
6,944,415 B1 * 9/2005 Nomura ..... 399/111

FOREIGN PATENT DOCUMENTS

| | | | |
|---|---|---|---|
| JP | 01108073 A | * | 4/1989 |
| JP | 04-219550 | | 8/1992 |
| JP | 04219550 A | * | 8/1992 |
| JP | 05265265 A | * | 10/1993 |
| JP | 2000112240 A | * | 4/2000 |
| JP | 2000347551 A | * | 12/2000 |
| JP | 2001-034022 | | 2/2001 |
| KR | 1993-020218 | | 10/1993 |
| KR | 2002-068429 | | 8/2002 |

* cited by examiner

*Primary Examiner*—Robert Beatty
(74) *Attorney, Agent, or Firm*—Roylance, Abrams, Berdo & Goodman, L.L.P.

(57) ABSTRACT

A developing unit of an image forming apparatus which can maintain a regular developing gap without a separate pressing member. The developing unit comprises a photoconductive drum which is rotatable, a developing roller rotating in association with the photoconductive drum and attaching a toner to the photoconductive drum, a toner supplying roller for supplying the toner to the developing roller, a first support body for rotatably supporting the photoconductive drum, and an idle gear being mounted in the first support body so that the centers of the idle gear, the photoconductive drum and the developing roller are arranged to form a triangle. In such an arrangement, a force is created and exerted upon the rollers to determine a position of the developing roller with respect to the photoconductive drum.

13 Claims, 8 Drawing Sheets

DEVELOPING UNIT WITH DEVELOPING GAP CONTROL

CROSS-REFERENCE TO RELATED APPLICATIONS

This application claims priority under 35 U.S.C. §119 to an application entitled "Developing Unit" filed in the Korean Intellectual Property Office on Jul. 14, 2003 and assigned Ser. No. 2003-47913, the entire content of which is incorporated herein by reference.

BACKGROUND OF THE INVENTION

1. Field of the Invention

The present invention relates to a developing unit of an image forming apparatus, and more particularly, to a non-contact type developing unit of an image forming apparatus using a single-component nonmagnetic toner.

2. Description of the Related Art

In a non-contact developing unit using a single-component nonmagnetic toner, it is typically required to maintain a regular gap (hereinafter, called 'developing gap') between a photoconductive drum and a developing roller. In addition, the developing roller is typically driven by a driving force transmitted from a photoconductive drum gear of the photoconductive drum to a developing roller gear of the developing roller. At this point, a developing gap irregularity is often caused by a repulsive force generated in a pressure angle $\alpha$ direction, as shown in FIGS. 1 to 3. Such an irregular developing gap has a severe influence on the image quality, and therefore, close maintenance of the regular developing gap is required.

One conventional way of maintaining the regular developing gap is by a developing unit as shown in FIG. 1.

According to FIG. 1, an example of a conventional developing unit 1 comprises a photoconductive part 20 and a developing part 40. The photoconductive part 20 includes a first support body 10, an electrifying roller 11 provided in the first support body, a photoconductive drum 12, a cleaning blade 13 and a waste toner tub 14. The developing part 40 includes a second support body 30, a developing roller 31 provided in the second support body 30, a controlling blade 32, a toner supplying roller 33 and a toner 34. The developing unit 1 further comprises a positioning member 50 which is included in the developing part 40 and rotatably supported by the photoconductive part 20 to determine a position of the developing roller 31 with respect to the photoconductive drum 12.

The above-structured developing unit 1 develops an electrostatic latent image on the photoconductive drum 12 as described in greater detail below. A driving force is transmitted from a main body of the image forming apparatus to the photoconductive drum gear (not shown) of the photoconductive drum 12, and transmitted from the photoconductive drum gear to the developing roller gear (not shown) of the developing roller 31. Also, the driving force is transmitted to a gear (not shown) of the toner supplying roller 33 via an idle gear (not shown), and thereby the photoconductive drum 12, the developing roller 31, and the toner supplying roller 33 are rotatably driven. Thus the electrostatic latent image is developed.

Here, in order to prevent the developing gap irregularity by the repulsive force generated in the pressure angle $\alpha$ occurring in the driving force transmitting process, the rotation point 51 of the positioning member 50 is placed on the pressure angle $\alpha$ vector, as shown in FIG. 1, thereby pressing the developing roller 31 to the photoconductive drum 12.

However, the conventional method of maintaining the developing gap by controlling only the rotation point 51 of the positioning member 50 has a difficulty in managing parts, since to function properly, the parts should be fabricated with high precision for providing the regular developing gap. In particular, a compact-sized developing unit is difficult to realize due to restrictions in determining the rotation point 51.

FIG. 2 is a sectional view illustrating another conventional method for maintaining the regular developing gap. In referring to the elements having the same structure and operation as shown in FIG. 1, the elements will be cited by the same reference numerals and detailed description thereof will be omitted.

According to FIG. 2, in a developing unit 2, a rotation point 51A of a positioning member 50A is placed in a predetermined range $\beta$ and a moment 91 is applied to press the developing roller 31 against the photoconductive drum 12 using a separate pressing member (not shown) to prevent the developing gap irregularity from occurring by the repulsive force generated in the pressure angle $\alpha$ of the gear during the transmission of the driving force.

The above conventional method maintains the regular developing gap of the developing roller 31 with respect to the photoconductive drum 12 by using the moment 91 obtained via a pressing member as well as controlling the rotation point 51A of the positioning member 50A. However, there are still problems, such as variation of a driving load according to toner quantity and usage. It is also difficult to plan for the pressing member considering both a tolerance of part size and assembly deviation. Therefore even in this approach, it is difficult to maintain a certain quality.

FIG. 3 is a sectional view of a developing unit for illustrating yet another conventional method of maintaining the regular developing gap. Again, the elements of the same structure of FIGS. 1 and 2 will be referred by the same reference numerals, and the description thereof are omitted.

Referring to FIG. 3, in a developing unit 3, a positioning member 50B is provided in a gravity-direction positioning member 15 which is mounted in the first support body 10 of the photoconductive part 20 to determine a first gravity-direction position. A member 60 is mounted in the main body of the image forming apparatus to determine a second gravity-direction position of the developing part 40.

In the above developing unit 3, to prevent the developing gap irregularity due to the repulsive force generated in a direction of the pressure angle $\alpha$ of the gear, positions of the positioning member 50B and the developing roller 31 are determined during transfer of the driving force. Specifically, the position of the positioning member 50B for determining the first gravity-direction position of the developing part 40 from the gravity-direction positioning member 15, and the developing roller 31 with respect to the photoconductive drum 12 to the second gravity-direction positioning member 60, are both determined during transfer of the driving force. Then, the moment 92 is applied to press the developing roller 31 against the photoconductive drum 12 using the separate pressing member (not shown).

However, the above method for maintaining the regular developing gap has similar problems as the developing unit 2 of FIG. 2, that is, it is difficult to design the pressing member while considering the variations of a driving load according to quantity and usage of the toner 34, including both parts size deviation and an assembly deviation. It is also hard to maintain quality of the pressing member at a certain level.

Accordingly, a need exists for a non-contact type developing unit of an image forming apparatus using a simple component to address the problems described above.

SUMMARY OF THE INVENTION

It is, therefore, an object of the present invention to overcome the above-mentioned problems of the prior art. An aspect of the present invention is to provide a developing unit capable of maintaining a regular developing gap without requiring a separate pressing member.

Another aspect of the present invention is to provide a compact-sized developing unit.

In order to achieve the above-described aspects of the present invention, a developing unit is provided comprising a photoconductive drum, a developing roller, a toner supplying roller, a first support body, and an idle gear.

The photoconductive drum is rotatable. The developing roller rotates in association with the photoconductive drum and attaches a toner to the photoconductive drum. The toner supplying roller supplies the toner to the developing roller. The first support body rotatably supports the photoconductive drum and the idle gear is also mounted in the first support body so that the centers of the idle gear, the photoconductive drum and the developing roller are arranged to form a triangle, so that a rotation driving force of the developing roller is transmitted to the toner supplying roller.

Accordingly, as a photoconductive drum gear, a developing roller gear, and the idle gear are driven, the centers of which are also arranged to form a triangle, the developing roller is applied with a force directed toward the photoconductive drum, and is thereby pressed against the photoconductive drum without requiring a pressing member.

According to a first embodiment of the present invention, the developing unit comprises a second support body for rotatably supporting the developing roller, and a positioning member is mounted in the second support body to determine a position of the developing roller with respect to the photoconductive drum and with an end thereof rotatably supported by the first support body. The rotation center of the positioning member is on a line labeled "G" connecting the centers of the idle gear and the developing roller.

Also in the first embodiment of the present invention, the second support body includes a developing chamber and a toner receptacle which are separate from each other. The toner receptacle is fixed to the first support body, and the developing chamber is rotatably supported in the first support body by the position determining member.

Further, according to first embodiment of the present invention, the developing unit comprises a gap maintaining member for maintaining a distance between axes of the photoconductive drum and the developing roller.

The gap maintaining member comprises a gap maintaining block in the first support body to support an axis of the developing roller at a side of the axis. Alternatively, the gap maintaining member may comprise a gap maintaining ring at one end or both ends of the developing roller in contact with the outer circumference of the photoconductive drum.

Additionally, the developing unit comprises a gravity-direction positioning member for determining a gravity-direction position of the second support body.

The gravity-direction positioning member comprises a first member mounted in the first support body to support an axis of the developing roller at a lower part thereof, and a second member mounted in the main body of the image forming apparatus to support the second support body. Here, the first member is an axis support block, and the second member is a roller.

According to a second embodiment of the present invention, a developing unit comprises a photoconductive drum which is rotatable, a developing roller rotating in association with the photoconductive drum and attaching a toner to the photoconductive drum, a toner supplying roller for supplying the toner to the developing roller, a first support body for rotatably supporting the photoconductive drum, a second support body for rotatably supporting the developing roller, a third support body mounted on both sides of the first and the second support bodies, respectively, to connect the first and the second support bodies, and an idle gear mounted in the third support body so that centers of the idle gear, the photoconductive drum and the developing roller are arranged to form a triangle. In such an arrangement, a rotation driving force of the developing roller is transmitted to the toner supplying roller.

Further, the developing unit according to the embodiments of the present invention comprises a positioning member being supported in the second support body with an end thereof being rotatably supported by the third support body to determine a position of the developing roller with respect to the photoconductive drum. A rotation center of the positioning member is on a line G connecting centers of the idle gear and the developing roller.

BRIEF DESCRIPTION OF THE DRAWINGS

These and other features, aspects, and advantages of the present invention will become better understood with regard to the following description, appended claims, and accompanying drawings where:

DETAILED DESCRIPTION OF THE PREFERRED EMBODIMENTS

Hereinafter, preferred embodiments of a developing unit according to the present invention will be described in detail with reference to the accompanying drawings.

Figure 1:
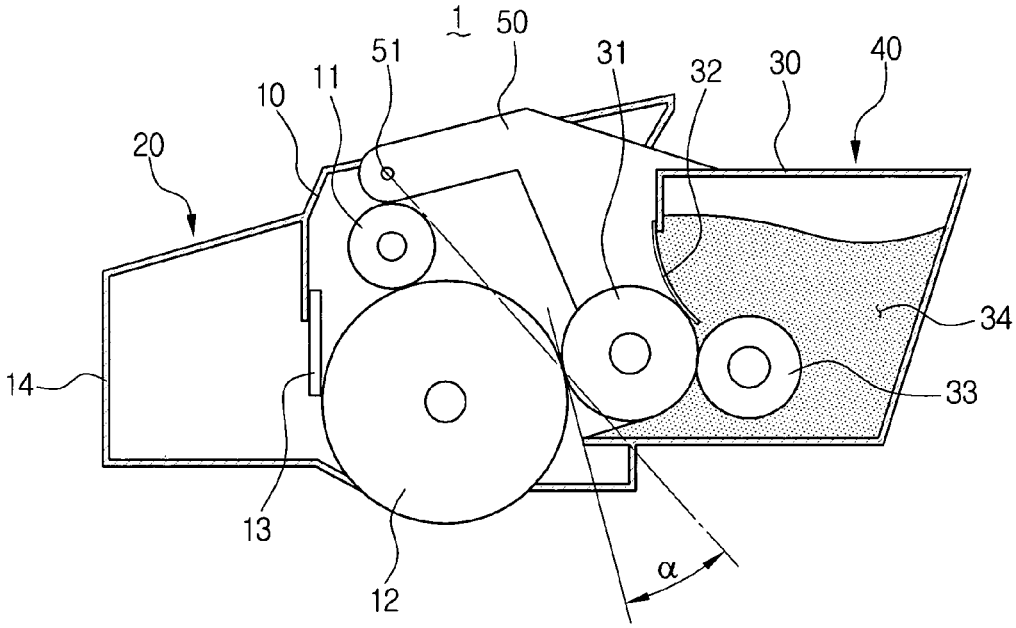
FIG. 1 (PRIOR ART)
FIG. 1 is a sectional view of an exemplary conventional developing unit.
Figure 2:
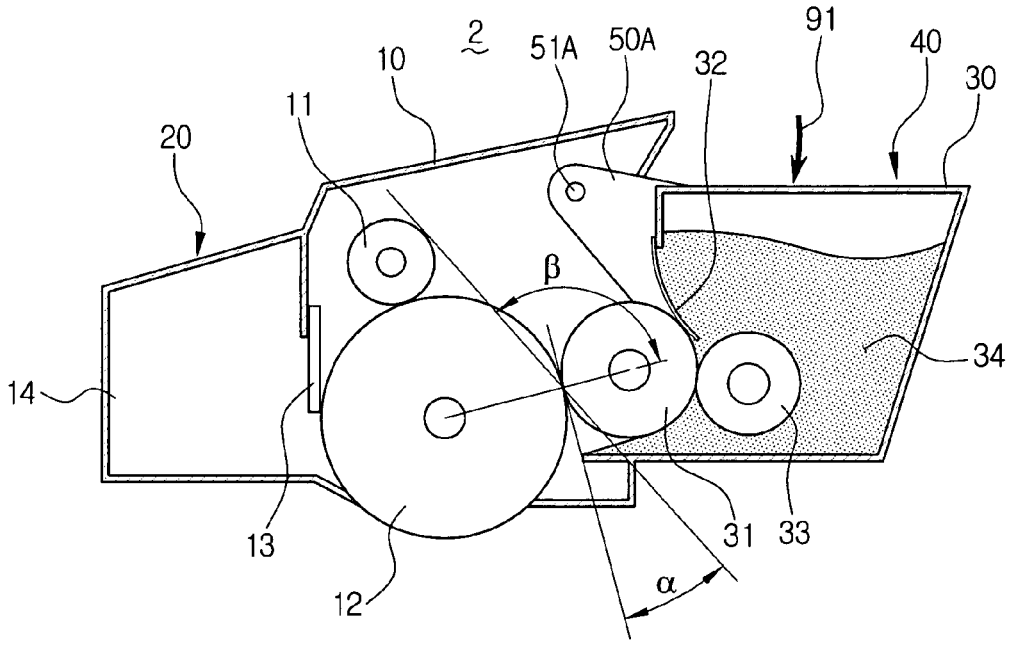
FIG. 2 (PRIOR ART)
FIG. 2 is a sectional view of another exemplary conventional developing unit.
Figure 3:
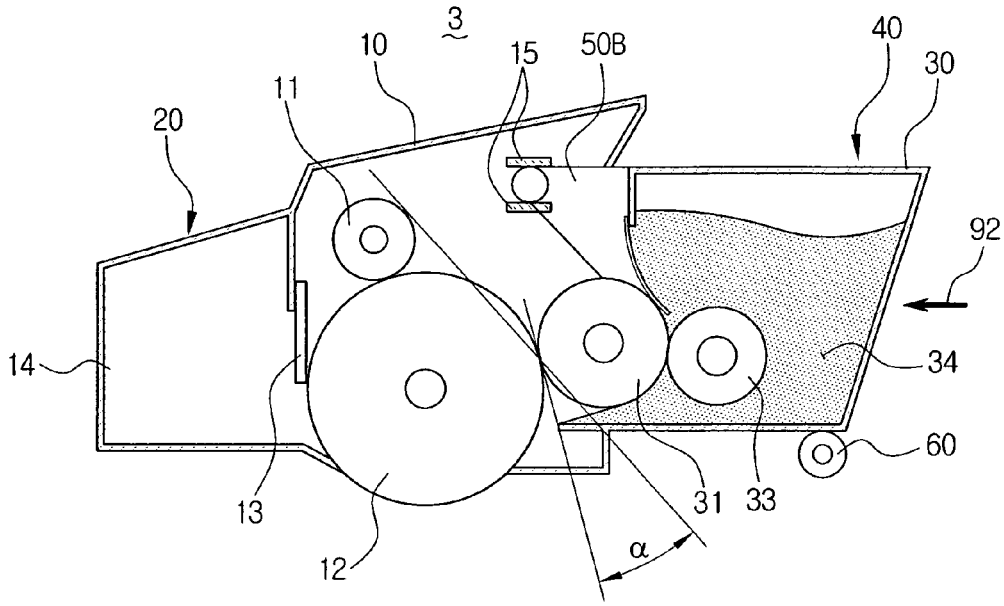
FIG. 3 (PRIOR ART)
FIG. 3 is a sectional view of yet another exemplary conventional developing unit.
Figure 4:
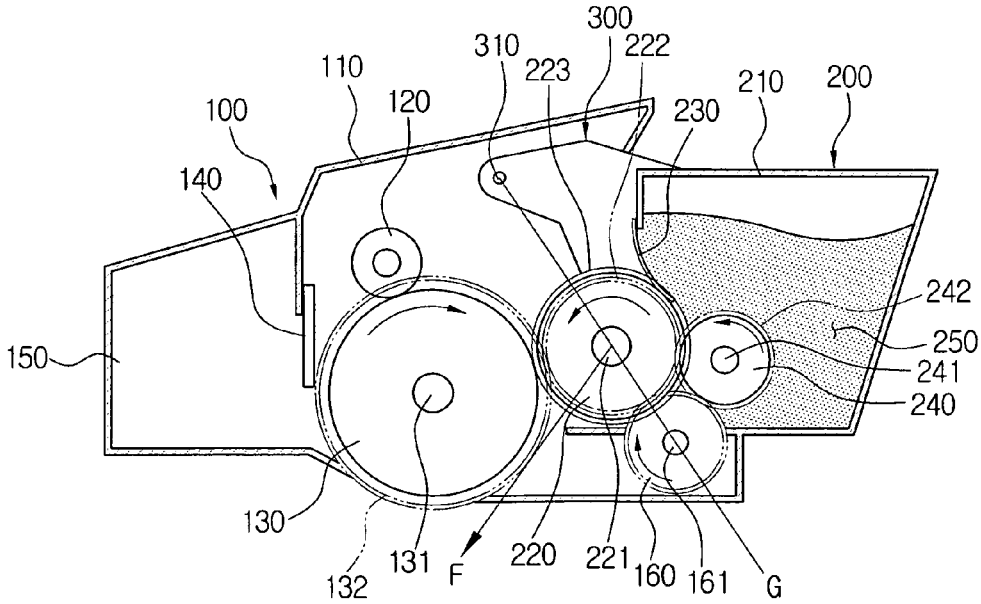
FIG. 4 is a sectional view of an example developing unit according to a first embodiment of the present invention.
Figure 8:
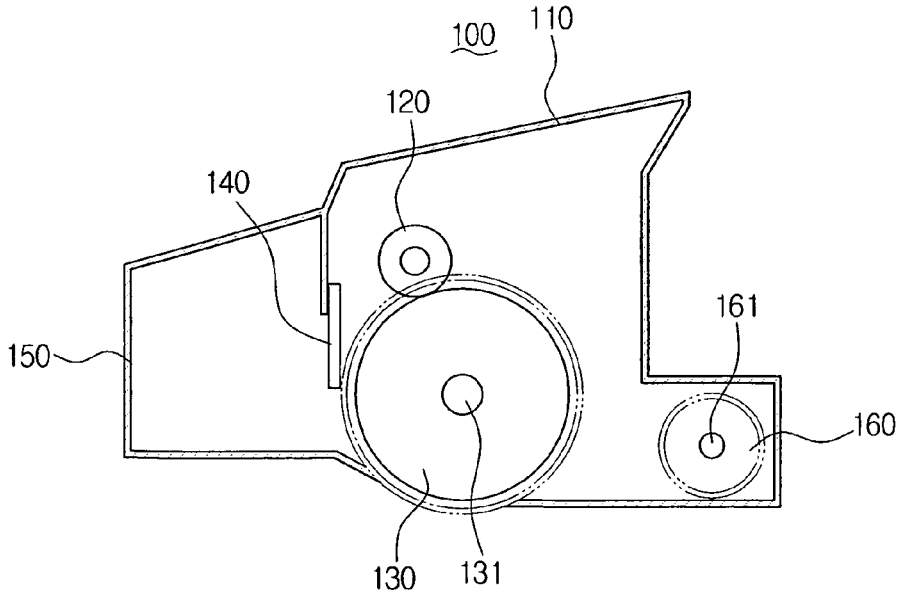
FIG. 8 is a schematic view of an example photoconductive part showing the arrangement of an idle gear which is a main element of the embodiment of the present invention of FIGS. 4 through 7.

FIG. 4 is a sectional view of an example developing unit according to a first embodiment of the present invention, and FIG. 8 is a schematic view of a photoconductive part. A reference numeral 100 refers to a photoconductive part, 200 is a developing part, and 300 is a position determining member. In the following description, the term "developing unit" denotes embodiments comprising a developing "part", photoconductive "part", and position determining "member". Exemplary elements of each of the developing part, photoconductive part, and position determining member are described in greater detail below.

As shown in FIGS. 4 and 8, the photoconductive part 100 comprises a first support body 110, an electrifying roller 120 provided in the first support body, a photoconductive drum 130, a cleaning blade 140 and a waste toner tub 150.

The photoconductive drum 130 is rotatably mounted in the first support body 110 by an axis 131 in the center thereof. Also, the photoconductive drum 130 comprises a photoconductive drum gear 132 for transmitting the rotation driving force to a developing roller 220 which is described in greater detail below.

Further, according to the present invention, an idle gear 160 is rotatably mounted at a predetermined position in the first support body 110 by an axis 161. Regarding this, a detailed description is provided below.

The developing part 200 comprises a second support body 210, a developing roller 220 provided in the second support body 210, a controlling blade 230, a toner supplying roller 240, and a toner 250.

The developing roller 220 is rotatably mounted in the second support body 210 by an axis 221 in the center thereof. In addition, the developing roller 220 comprises a developing roller gear 222 engaged with the photoconductive drum gear 132, and attaches the toner 250 to the photoconductive drum 130 when rotating in association with the photoconductive drum 130. Further, the developing roller 220 comprises a gap maintaining ring 223 mounted at one end or both ends of the developing roller 220 and contacting an outer circumference of the photoconductive drum 130. The gap maintaining ring 223 functions as a gap maintaining member for maintaining a distance between axes of the developing roller 220 and the photoconductive drum 130.

The toner supplying roller 240 supplies the toner 250 to the developing roller 220, and is rotatably mounted in the second support body 210 by an axis 241 in the center thereof. Additionally, the toner supplying roller 240 comprises a passive gear 242 engaged with the idle gear 160.

The idle gear 160, added according to one aspect of the present invention, is engaged with the developing gear 222 and the passive gear 242, and thereby, the rotation driving force of the photoconductive drum 130 is transmitted to the passive gear 242 through the developing roller gear 222 and the idle gear 160. Here, the idle gear 160 is disposed at a predetermined position in the first support body 110 so that a center thereof 01, a center 02 of the photoconductive drum gear 132, and a center 03 of the developing roller gear 222, are arranged to make up a triangle as shown in FIG. 9.

Figure 9:
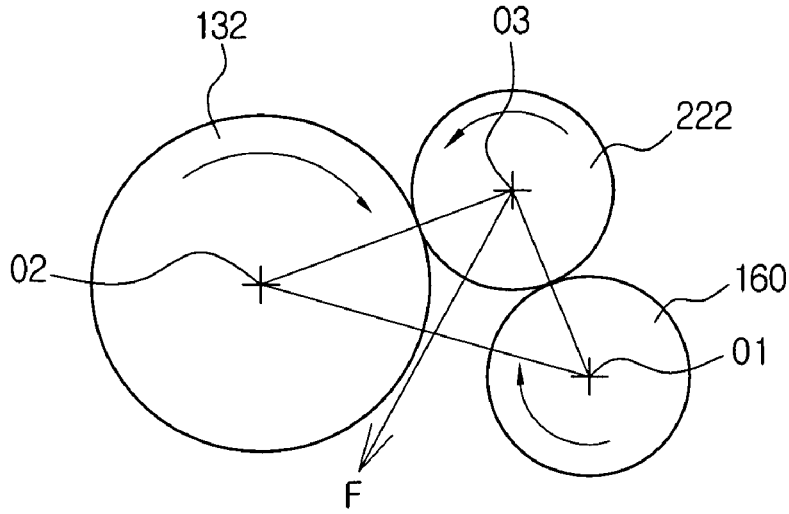
FIGS. 9 to 12 are drawings for illustrating a principle for maintaining a regular developing gap of the developing unit according to the embodiments of the present invention.
Figure 10:
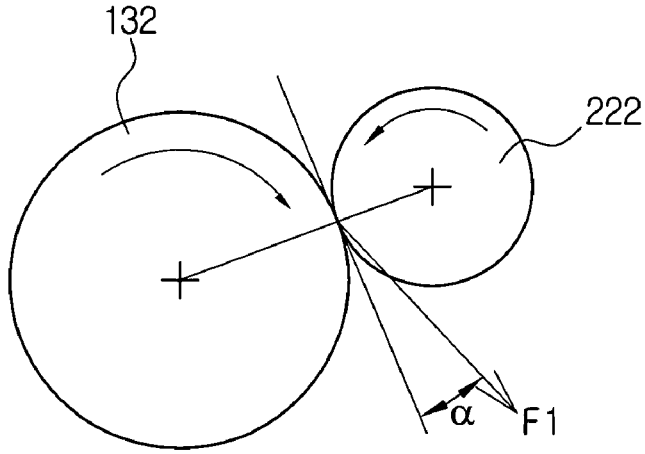
Figure 11:
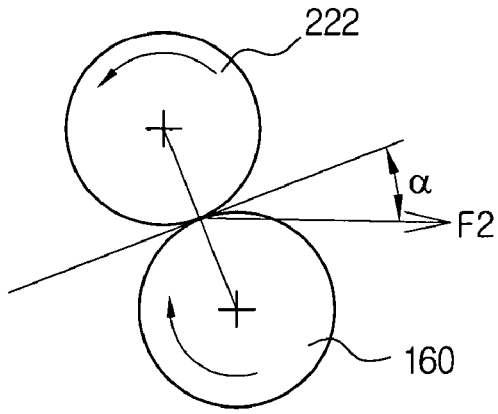
Figure 12:
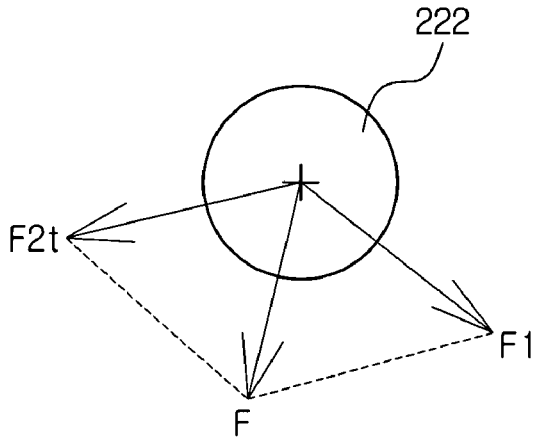

According to the triangular arrangement of the three gears, a force labeled "F" of FIG. 9 is generated as the gears drive. Therefore, the developing roller 220 is stably pressed against the photoconductive drum 130 without having to use a pressing member as in the conventional developing unit. Referring to FIGS. 10 to 12, the above triangle structure is described in detail.

Referring to FIG. 10, when the photoconductive drum gear 132 drives the developing roller gear 222, a force labeled "F1" is generated in a direction of the pressure angle $\alpha$ of the gear, and thereby the developing roller 220 is pushed from the photoconductive drum 130. Also, as shown in FIG. 11, a force labeled "F2" is generated in a direction of the pressure angle $\alpha$ when the developing roller gear 222 drives the idle gear 160. Here, if the idle gear 160 is mounted firmly, the developing roller gear 222 is again pushed toward the photoconductive drum 130 by a reaction force labeled "F2*t*" of F2 as shown in FIG. 12. Accordingly, by the association of the two forces F1 and F2*t* of FIG. 12, the developing roller gear 222 is stably pressed against the photoconductive drum 130 by the force F, as shown in FIG. 9.

Returning to FIG. 4, the positioning member 300 connects the first and the second support bodies 110 and 210, and supports the second support body 210 rotatably with respect to the first support body 110 to press the developing roller 220 against the photoconductive drum 130. By this, the position of the developing roller 220 with respect to the photoconductive drum 130 can be kept regular. At this point, the positioning member 300 is mounted in the second support body 210, and the end thereof is supported by the first support body 110 by a hinge. Here, the center of the hinging movement of the positioning member 300, that is, the rotation center 310, lies in a line G which connects the centers of the idle gear 160 and the developing roller 220.

Figure 5:
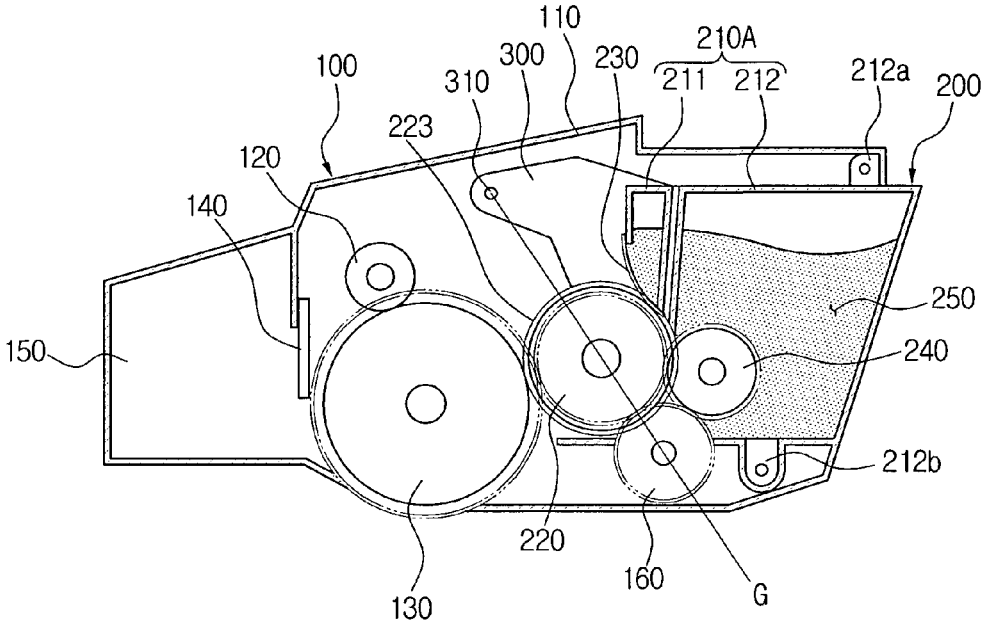
FIG. 5 is a sectional view of an example developing unit according to a second embodiment of the present invention.

FIG. 5 is a sectional view of an example developing unit according to a second embodiment of the present invention. Referring to FIG. 5, the developing unit is similarly structured to the first embodiment except wherein the second support body 210A, which constitutes the developing part 200, is divided into a developing chamber 211 and a toner receptacle 212. The toner receptacle 212 is fixed to the first support body 110 in a manner that an upper and a lower fastener pieces 212*a* and 212*b* are fastened by a fastening element of corresponding parts of the first support body 110 which constitutes the photosensitive part 100. The developing chamber 211 is rotatably mounted on the line G of the first support body 110 by the positioning member 300. The structure and the operation of the other elements are the same as described in the first embodiment, and therefore, description thereof will be omitted.

Figure 6:
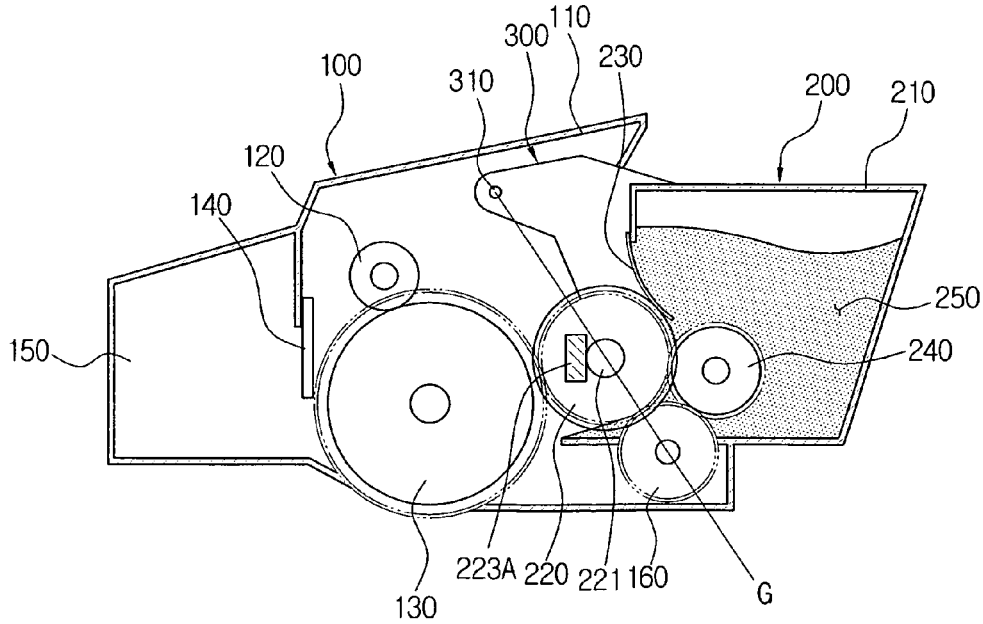
FIG. 6 is a sectional view of an example developing unit according to a third embodiment of the present invention.

FIG. 6 shows an example developing unit according to a third embodiment of the present invention. As shown in FIG. 6, the developing unit according to the third embodiment comprises a gap maintaining block 223A as a gap maintaining member for maintaining a distance between axes of the developing roller 220 with respect to the photoconductive drum 130. The gap maintaining block 223A is formed in the first support body 110 to support a side of an axis 221 of the developing roller 220. The other structure is the same as the first embodiment. Therefore, the same elements will be referred by the same numeral references and the description thereof will be omitted.

Figure 7:
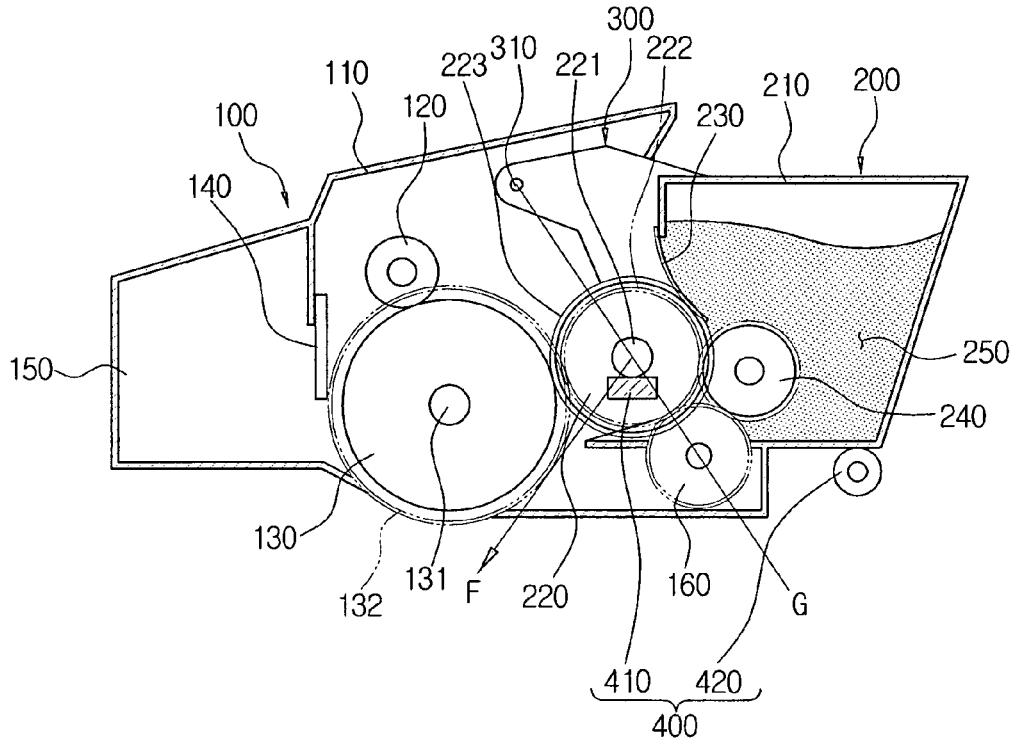
FIG. 7 is a sectional view of an example developing unit according to a fourth embodiment of the present invention.

FIG. 7 is an example developing unit according to the fourth embodiment of the present invention. The developing unit of FIG. 7 comprises a gravity-direction positioning member 400 for determining a gravity-direction position of the second support body 210 which constitutes the developing part 200. The remaining components of the fourth embodiment have the same structure as the above-described first embodiment, and accordingly, a description will be given hereinafter only regarding the gravity-direction positioning member 400.

The gravity-direction positioning member 400 comprises an axis support block 410 as a first member which is mounted in the first support body 110 which constitutes the photoconductive part 100 to support the axis 221 at a lower part of the axis 221 of the developing roller 220. The gravity-direction positioning member 400 further comprises a roller 420 as a second member which is mounted in the main body of the image forming apparatus to support the second support body 210. In this embodiment, in a state where a first gravity-direction position of the developing part 200 is determined by the axis support block 410 and the positioning member 300, and a second gravity-direction position is determined by the roller 420, the developing roller 220 is pressed against the photoconductive drum 130 by the force F. As noted above, the force F is generated during the transfer of driving forces among the photoconductive drum gear 132, the developing roller gear 222 and the idle gear 160. As a result, a stable and regular developing gap can be guaranteed.

Figure 13:
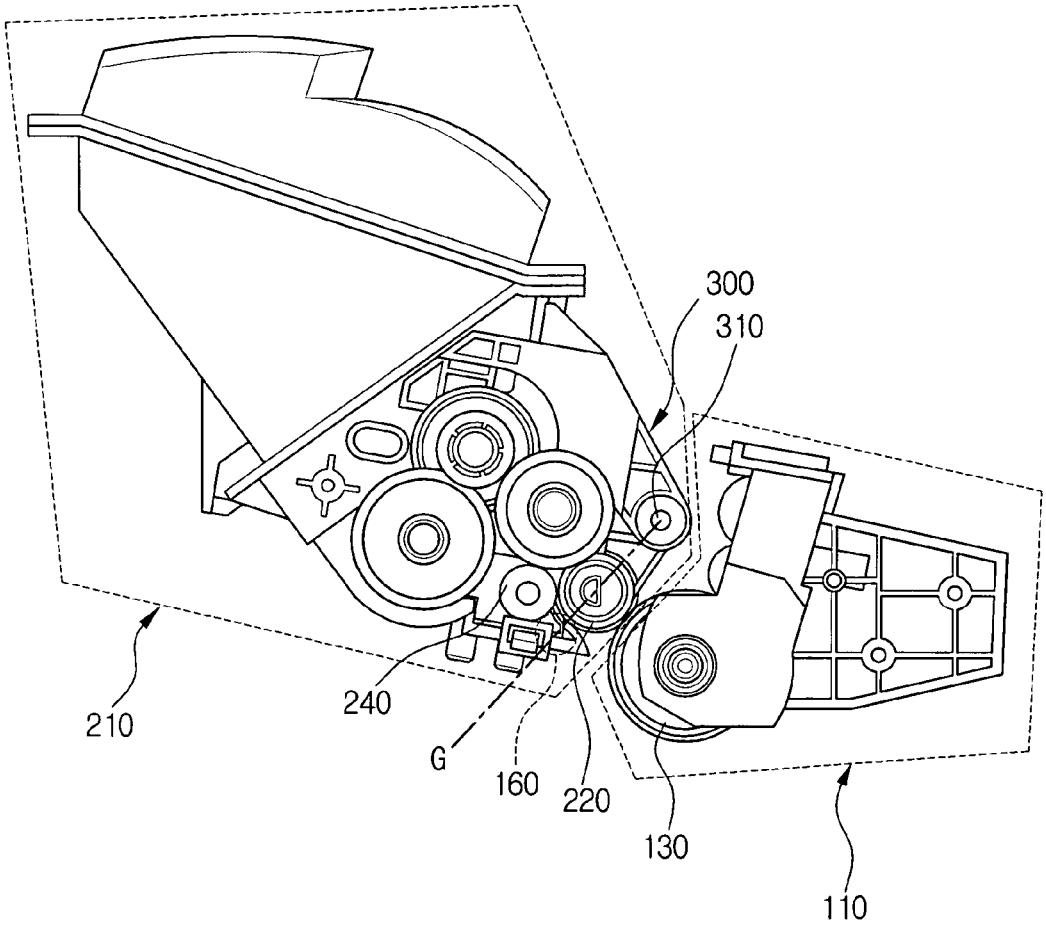
FIG. 13 is a sectional view of an example developing unit according to a fifth embodiment of the present invention.
Figure 14:
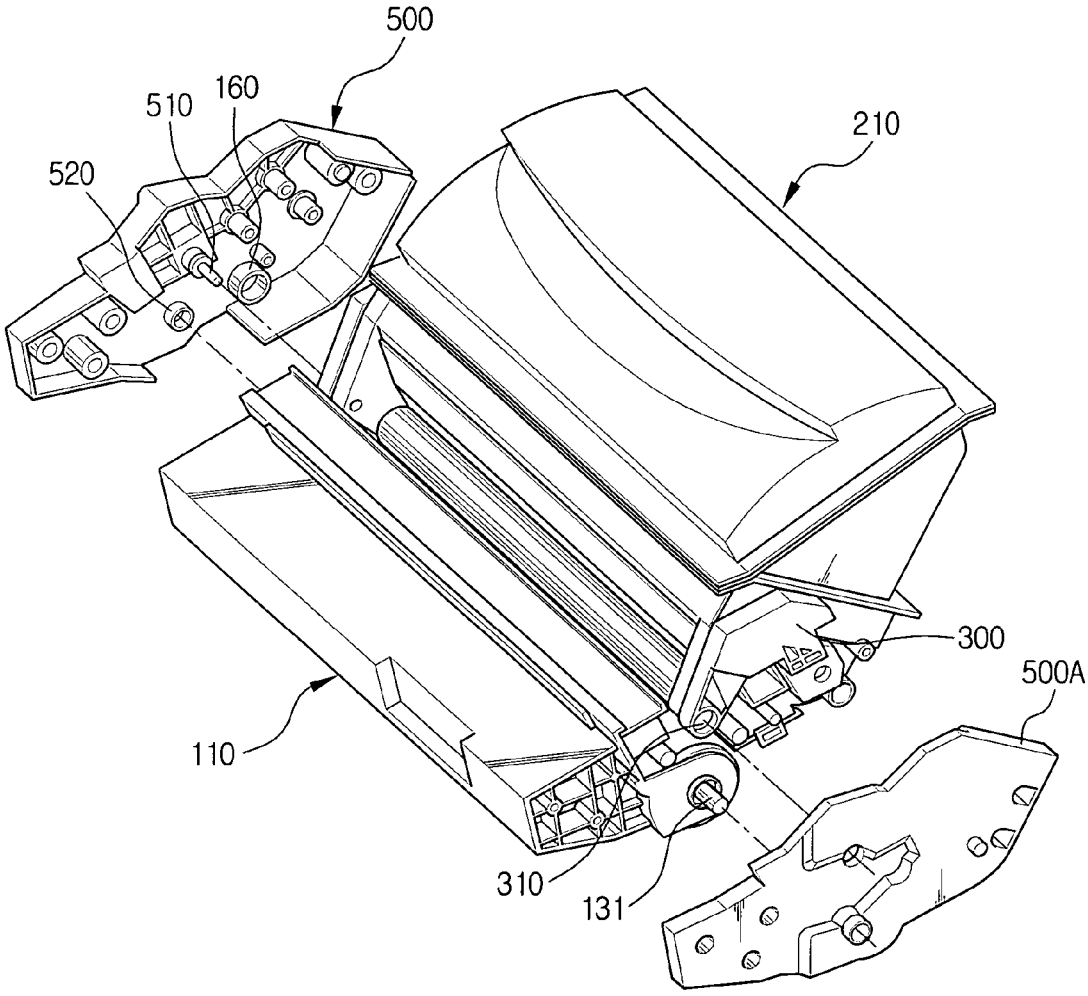
FIG. 14 is an exploded perspective view of a third support body of the developing unit of FIG. 13.

FIGS. 13 and 14 show a sectional view and a perspective view of an example developing unit according to the fifth embodiment of the present invention, respectively.

As shown in FIGS. 13 and 14, the features of the developing unit according to the fifth embodiment, comprise third support bodies 500 and 500A for connecting the first support body 110, rotatably supporting the photoconductive drum 130, with the second support body 210, rotatably supporting the developing roller 220. The idle gear 160 is mounted in the third support bodies 500 and 500A.

The idle gear 160 is arranged so that the centers of the idle gear 160, the photoconductive drum 130, and the developing roller 220 form a triangle, as described above in the other embodiments. The idle gear 160 functions to transmit the rotation driving force of the developing roller 220 to the toner supplying roller 240.

In addition, the positioning member 300 is provided for determining the position of the developing roller 220 with respect to photoconductive drum 130. The positioning member 300 is mounted in the second support body 210, with an end thereof rotatably supported by the third support bodies 500 and 500A. The rotation center 310 of the positioning member 300 is on the line G connecting the centers of the idle gear 160 and the developing roller 220.

Accordingly, the third support bodies 500 and 500A further comprise a hinge 510 for rotatably supporting the positioning member 300, and a drum supporting portion 520 for supporting the axis 131 of the photoconductive drum 130 as shown in FIG. 14.

The structure and the operation of the other elements are substantially the same as the other embodiments described above, and therefore, a detailed description thereof is omitted.

As described above, the developing unit according to the present invention is capable of stably maintaining a regular developing gap without requiring a pressing member, and can be manufactured having a compact size since the center of rotation of the positioning member can be set up within a relatively wide range.

That is, according to the embodiments of the present invention, there can be provided an image forming apparatus maintaining a regular developing gap without requiring a pressing member, thereby providing a good-quality image in a simple structure.

Additionally, since the image forming apparatus can be of a compact size, the handling and maintenance becomes convenient, and accordingly, the product can be very satisfying to the users.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. A developing unit, comprising:

a photoconductive drum which is rotatable;

a developing roller rotating in association with the photoconductive drum for attaching a toner to the photoconductive drum;

a toner supplying roller for supplying the toner to the developing roller;

a first support body for rotatably supporting the photoconductive drum;

a second support body for rotatably supporting the developing roller; and an idle gear being mounted in the first support body so that a center of the idle gear, the photoconductive drum and the developing roller are arranged to form a triangle shape, such that a rotation driving force of the developing roller is transmitted to the toner supplying roller and wherein the arrangement of the photoconductive drum, the developing roller, and the idle gear produce forces which sum to urge the developing roller toward the photoconductive drum.

2. A developing unit, comprising:

a photoconductive drum which is rotatable;

a developing roller rotating in association with the photoconductive drum for attaching a toner to the photoconductive drum;

a toner supplying roller for supplying the toner to the developing roller;

a first support body for rotatably supporting the photoconductive drum;

an idle gear being mounted in the first support body so that a center of the idle gear, the photoconductive drum and the developing roller are arranged to form a triangle shape, such that a rotation driving force of the developing roller is transmitted to the toner supplying roller;

a second support body for rotatably supporting the developing roller; and a positioning member mounted in the second support body to determine a position of the developing roller with respect to the photoconductive drum, and having an end thereof being rotatably supported by the first support body, wherein a rotation center of the positioning member is on a line connecting the centers of the idle gear and the developing roller.

3. The developing unit of claim 2, wherein:

the second support body includes a developing chamber and a toner receptacle which are separate from each other, wherein the toner receptacle is fixed to the first support body, and the developing chamber is rotatably supported in the first support body by the position determining member.

4. The developing unit of claim 2, further comprising:

a gap maintaining member for maintaining a distance between axes of the photoconductive drum and the developing roller.

5. The developing unit of claim 2, further comprising:

a gap maintaining block mounted in the first support body to support an axis of the developing roller at a side of the axis.

6. The developing unit of claim 4, wherein:

the gap maintaining member comprises a gap maintaining ring at one end or both ends of the developing roller in contact with an outer circumference of the photoconductive drum.

7. The developing unit of claim 2, further comprising:

a gravity-direction positioning member for determining a gravity-direction position of the second support body.

8. The developing unit of claim 7, wherein the gravity-direction positioning member comprises:

a first member mounted in the first support body to support an axis of the developing roller at a lower part thereof; and a second member mounted in the main body of the image forming apparatus to support the second support body.

9. The developing unit of claim 8, wherein the first member includes an axis support block, and the second member includes a roller.

10. A developing unit of claim 2, further comprising a single said idle gear.

11. A developing unit, comprising:

a photoconductive drum which is rotatable;

a developing roller rotating in association with the photoconductive drum for attaching a toner to the photoconductive drum;

a toner supplying roller for supplying the toner to the developing roller;

a first support body for rotatably supporting the photoconductive drum;

a second support body for rotatably supporting the developing roller;

a third support body mounted on both sides of the first and the second support bodies, respectively, to connect the first and the second support bodies; and an idle gear mounted in the third support body so that a center of the idle gear, the photoconductive drum and the developing roller are arranged to form a triangle shape, such that a rotation driving force of the developing roller is transmitted to the toner supplying roller.

12. The developing unit of claim 11, further comprising:

a positioning member being supported in the second support body with an end thereof being rotatably supported by the third support body, to determine a position of the developing roller with respect to the photoconductive drum; and wherein a rotation center of the positioning member is on a line connecting the center of the idle gear and the center of the developing roller.

13. A developing unit of claim 11, further comprising a single said idle gear.

* * * * *